US007804018B2

(12) United States Patent
Tamura

(10) Patent No.: US 7,804,018 B2
(45) Date of Patent: Sep. 28, 2010

(54) ELECTRIC STRINGED MUSICAL INSTRUMENT AND PICKUP UNIT INCORPORATED THEREIN FOR CONVERTING VIBRATIONS TO SIGNAL

(75) Inventor: Shinya Tamura, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 11/761,768

(22) Filed: Jun. 12, 2007

(65) Prior Publication Data

US 2007/0295195 A1 Dec. 27, 2007

(30) Foreign Application Priority Data

Jun. 12, 2006 (JP) ..... 2006-162219

(51) Int. Cl.
*G10H 3/18* (2006.01)

(52) U.S. Cl. ..... 84/731; 84/723; 84/726; 84/727; 84/730

(58) Field of Classification Search ..... 84/723, 84/726, 727, 730, 731
See application file for complete search history.

(56) References Cited

U.S. PATENT DOCUMENTS

| | | | | |
|---|---|---|---|---|
| 3,003,382 | A | 10/1961 | Fender | |
| 4,218,951 | A | 8/1980 | Tressel | |
| 4,843,937 | A * | 7/1989 | Murphy | 84/723 |
| 5,123,326 | A | 6/1992 | Clevinger | |
| 5,641,932 | A | 6/1997 | Lace | |
| 5,945,622 | A * | 8/1999 | Yamada | 84/731 |
| 6,018,120 | A * | 1/2000 | Steinberger | 84/731 |
| 2001/0024067 | A1* | 9/2001 | Fishman | 310/1 |
| 2003/0094094 | A1* | 5/2003 | Nakaya | 84/736 |
| 2006/0011049 | A1* | 1/2006 | Takabayashi | 84/734 |
| 2006/0042454 | A1* | 3/2006 | Tamura | 84/730 |
| 2006/0042455 | A1* | 3/2006 | Schatten | 84/731 |
| 2006/0117938 | A1* | 6/2006 | Gillette | 84/723 |
| 2006/0213358 | A1* | 9/2006 | Motsenbocker | 84/731 |
| 2006/0219093 | A1* | 10/2006 | Urbanski | 84/731 |

FOREIGN PATENT DOCUMENTS

| | | |
|---|---|---|
| EP | 0 840 282 | 5/1998 |
| EP | 1 630 787 | 3/2006 |
| JP | 3180689 B2 | 6/2001 |
| JP | 2003-150164 | 5/2003 |
| WO | WO 99/39543 | 8/1999 |

* cited by examiner

*Primary Examiner*—Bentsu Ro
*Assistant Examiner*—Kawing Chan
(74) *Attorney, Agent, or Firm*—Dickstein Shapiro LLP

(57) ABSTRACT

An electric cello is equipped with a pickup unit under a bridge, and strings are stretched to press the bridge; the pickup unit has a bridge tray where the bridge stands and a piezoelectric transducer provided beneath the bridge tray, and the bridge tray is bolted at a side portion under the thick string to the instrument body; however, the other side portion under the thin string is made freely vibrate; while a player is bowing on the strings, the vibrating strings give rise to rolling of the bridge, and the leg portions of bridge are alternately pressed on the side portion and the other side portion; only the vibration of the other side portion give rise to deformation of piezoelectric converter so that the piezoelectric converter is free from interference of the bolted side portion.

20 Claims, 9 Drawing Sheets

ELECTRIC STRINGED MUSICAL INSTRUMENT AND PICKUP UNIT INCORPORATED THEREIN FOR CONVERTING VIBRATIONS TO SIGNAL

FIELD OF THE INVENTION

This invention relates to an electric stringed musical instrument and, more particularly, to an electric stringed musical instrument such as, for example, an electric rubbed string musical instrument for producing electric tones from an audio signal expressing vibrations of strings and a pickup unit incorporated in the electric stringed musical instrument.

DESCRIPTION OF THE RELATED ART

An electric violin and an electric cello are examples of the electric stringed musical instrument, and a typical example of the electric stringed musical instrument is shown in FIG. 1. The electric stringed musical instrument is broken down into an instrument body 1, strings 2, a bridge 3, a piezoelectric converter 4 and a sensor holder 5. The instrument body 1 has a longitudinal direction, and the strings 2 are stretched over the instrument body 1. In this instance, four strings 2*a*, 2*b*, 2*c* and 2*d* are prepared for players. The string 2*a* is the thickest, and the string 2*d* is the thinnest of all. In other words, the tones in the highest pitched part are produced by means of the string 2*d* .

A shallow recess 8 is formed in the front surface portion of the instrument body 1, and the sensor holder 5 is snugly received in the shallow recess 8. The piezoelectric converter 4 is placed in the sensor holder 5, and a signal cable 6 is connected to the piezoelectric converter 4. The bridge 3 stands on the piezoelectric converter 4, and gives tension to the strings 2*a*, 2*b*, 2*c* and 2*d* . When a player bows a music tune on the strings 2*a*, 2*b*, 2*c* and 2*d*, vibrations take place in the strings 2*a*, 2*b*, 2*c* and 2*d*, and are propagated from the strings 2*a*, 2*b*, 2*c* and 2*d* to the piezoelectric converter 4 through the bridge 3.

The bridge 3 has a crown portion 3A and two leg portions 3B1 and 3B2. Semi-column shaped recesses 9 are formed in the crown portion 3A, and the strings 2*a*, 2*b*, 2*c* and 2*d* are pressed onto the inner surface of the crown portion 3A defining the semi-column shaped recesses. The leg portions 3B1 and 3B2 downwardly project from the crown portion 3A, and are laterally spaced from one another on the piezoelectric converter 4.

The piezoelectric converter 4 has a piezoelectric element 4A, and the piezoelectric element 4A is offset from the center of the sensor holder 7 to the right side of the instrument body 1 as shown in FIG. 2. In this situation, when the bridge 3 is provided between the strings 2*a*, 2*b*, 2*c* and 2*d* and the piezoelectric converter 4, the right leg portion 3B2 is located over the piezoelectric element 4A. However, the left leg portion 3B1 is spaced from the piezoelectric element 4A. As a result, the vibration propagating path for the lower pitched part is longer than the vibration propagating path for the higher pitched part is. This results in that difference in the vibration-to-electric signal converting characteristics of the piezoelectric converter 4 between the higher pitched part and the lower pitched part. Thus, a problem is encountered in the prior art electric stringed musical instrument shown in FIG. 1 in that the vibrations of strings 2*a*, 2*b*, 2*c* and 2*d* are not accurately converted to the electric signals output from the piezoelectric converter 4.

The above-described problem is not overcome with a pair of piezoelectric elements. This is because of the fact that the vibrating strings tend to give rise to the movements of one of the leg portions 3B1 and 3B2 anti-phase of the movements of the other of the leg portions 3B1 and 3B2. In detail, while the string or strings are vibrating, the vibrating string or vibrating strings give rise to rolling of the bridge, and the rolling bridge makes the two legs alternately exert the force on the piezoelectric elements. When one of the legs increases the force on the associated piezoelectric element, the other of the legs decreases the force on the associated piezoelectric element. The output signal is output from one of the piezoelectric element out of phase with the output signal produced in the other piezoelectric element. For this reason, the output signals are partially canceled with one another, and the sound system suffers from the small amplitude of the electric signal after the mixing.

A countermeasure is proposed in Japanese Patent No. 3180689, the prior art electric stringed musical instrument of which is hereinafter referred to as the "first countermeasure", and Japanese Patent Application laid-open No. 2003-150164, the prior art electric stringed musical instrument of which is hereinafter referred to as the "second countermeasure".

The piezoelectric converter incorporated in the first countermeasure includes two piezoelectric converters respectively provided under the two legs of the bridge. However, one of the piezoelectric elements serves as a dummy. The electric signal expressing the vibrations of strings is taken out from the other of the piezoelectric elements. The dummy piezoelectric element makes the condition under one of the legs same as that under the other of the legs so as to make the electric signal output from the other piezoelectric element at high fidelity as to the vibrations of strings.

Two piezoelectric converters are incorporated in the second countermeasure. Each of the piezoelectric converters has an insulating layer sandwiched between two piezoelectric elements. The two piezoelectric converters are respectively provided under the two legs of the bridge, and are connected in parallel. Each of the piezoelectric converters is equivalent to a capacitor so that the capacitors connected in parallel are equivalent to the capacitors connected in parallel. As a result, the output impedance of the piezoelectric converter system is lowered, and the cut-off frequency is decreased. For this reason, low frequency components are easily converted to the electric signal, and the noise-to-signal ratio is improved.

However, a problem is encountered in the first and second countermeasures in the high production cost. In detail, the legs of bridge are directly pressed to the piezoelectric converter in the first countermeasure, and, for this reason, the piezoelectric converter is liable to be broken. In order to make the piezoelectric converter well endure the repetition of the exertion of force, the manufacturer employs a custom feature in the piezoelectric converter, and the custom feature makes the production cost increased. In the second countermeasure, two pairs of piezoelectric elements, which are four times as many as the piezoelectric element of the prior art shown in FIGS. 1 and 2, are required for the piezoelectric converter, and this results in the increase of production cost.

SUMMARY OF THE INVENTION

It is therefore an important object of the present invention to provide an electric stringed musical instrument, which produces electric tones at high fidelity.

It is also an important object of the present invention to provide a pickup unit incorporated in the electric stringed musical instrument for converting vibrations of the strings to an electric signal.

To accomplish the object, the present invention proposes to restrain a side portion of a bridge to an instrument body.

In accordance with one aspect of the present invention, there is provided an electric stringed musical instrument for producing electric tones comprising an instrument body having a longitudinal direction and a lateral direction, plural strings stretched over the instrument body in the longitudinal direction and selectively vibrating for specifying the electric tones to be produced, a bridge provided between the plural strings and the instrument body, the vibrating strings gives rise to rolling of the bridge, and the electric stringed musical instrument further comprises a pickup unit provided between the bridge and the instrument body for converting the rolling of the bridge to an electric signal representative of the specified electric tones and including a bridge tray having a side portion, another side portion and a surface on which the bridge stands, a fixture restraining the side portion to the instrument body and permitting the aforesaid another side portion freely vibrating and a vibration-to-electric signal converter held in contact with the aforesaid another side portion and converting the vibrations of the aforesaid another side portion to the electric signal.

In accordance with another aspect of the present invention, there is provided a pickup unit used for an electric stringed musical instrument having a longitudinal direction and a lateral direction comprising a bridge tray having a side portion, another side portion and a surface on which a bridge of the electric stringed musical instrument stands, a fixture restraining the side portion to an instrument body of the electric stringed musical instrument and permitting the aforesaid another side portion freely vibrating, and a vibration-to-electric signal converter held in contact with the aforesaid another side portion and converting the vibrations of the aforesaid another side portion due to rolling of the bridge to an electric signal expressing electric tones specified through vibrations of strings of the musical instrument.

BRIEF DESCRIPTION OF THE DRAWINGS

The features and advantages of the electric stringed musical instrument and pickup unit will be more clearly understood from the following description taken in conjunction with the accompanying drawings, in which.

DESCRIPTION OF THE PREFERRED EMBODIMENTS

In the following description, a direction parallel to the strings stretched over an instrument body is modified with term "longitudinal", and a "lateral direction" crosses the longitudinal direction. A direction normal to a plane defined by the longitudinal direction and lateral direction is modified with term "perpendicular", and is in parallel to thickness of the instrument body.

An electric stringed musical instrument embodying the present invention largely comprises an instrument body, plural strings, a bridge and a pickup unit. The strings are stretched over the instrument body in the longitudinal direction, and are spaced from one another in the lateral direction. The bridge stands on a surface of the instrument body, and projects in the perpendicular direction. Tension is exerted on the strings. The strings pass the bridge, and the component force of tension makes the bridge pressed on the surface of the instrument body. Thus, the bridge is provided between the instrument body and the strings.

While a player is performing a music tune on the electric stringed musical instrument, the player gives rise to vibrations of the strings, and the vibrating strings mainly give rise to rolling of the bridge. While the bridge is rolling, the bridge vibrates in the lateral direction, and repeatedly exerts force on the pickup unit in the perpendicular direction. Since the bridge vibrates in the lateral direction, the area applied with the force is alternately changed between side portions of the pickup unit. The vibrations of bridge is converted to an electric signal by means of the pickup unit, and the electric signal is converted to electric tones through a suitable converter such as, for example, a sound system.

The pickup unit includes a bridge tray, a fixture and a vibration-to-electric signal converter. The bridge tray has a surface on which the bridge stands, and the force is alternately exerted on both side portions of the surface during the rolling motion of bridge. The fixture restrains one of the side portions to the instrument body, and permits another side portion freely to vibrate. The vibration-to-electric signal converter is connected to the aforesaid another side portion. This feature is desirable, because the vibration-to-electric signal converter is much more sensitive to the vibrations of the aforesaid another side portion rather than the vibrations of the restrained side portion. In other words, the vibration of the restrained side portion does not have an influence on the vibration-to-electric signal converter. For this reason, the pickup unit produces the electric signal expressing the vibrations of bridge due to the vibrations of strings without interference between the vibrations of the side portion and the vibrations of another side portion. In other words, the pickup unit produces the electric signal at high fidelity to the vibrations of strings.

First Embodiment

Figure 3:
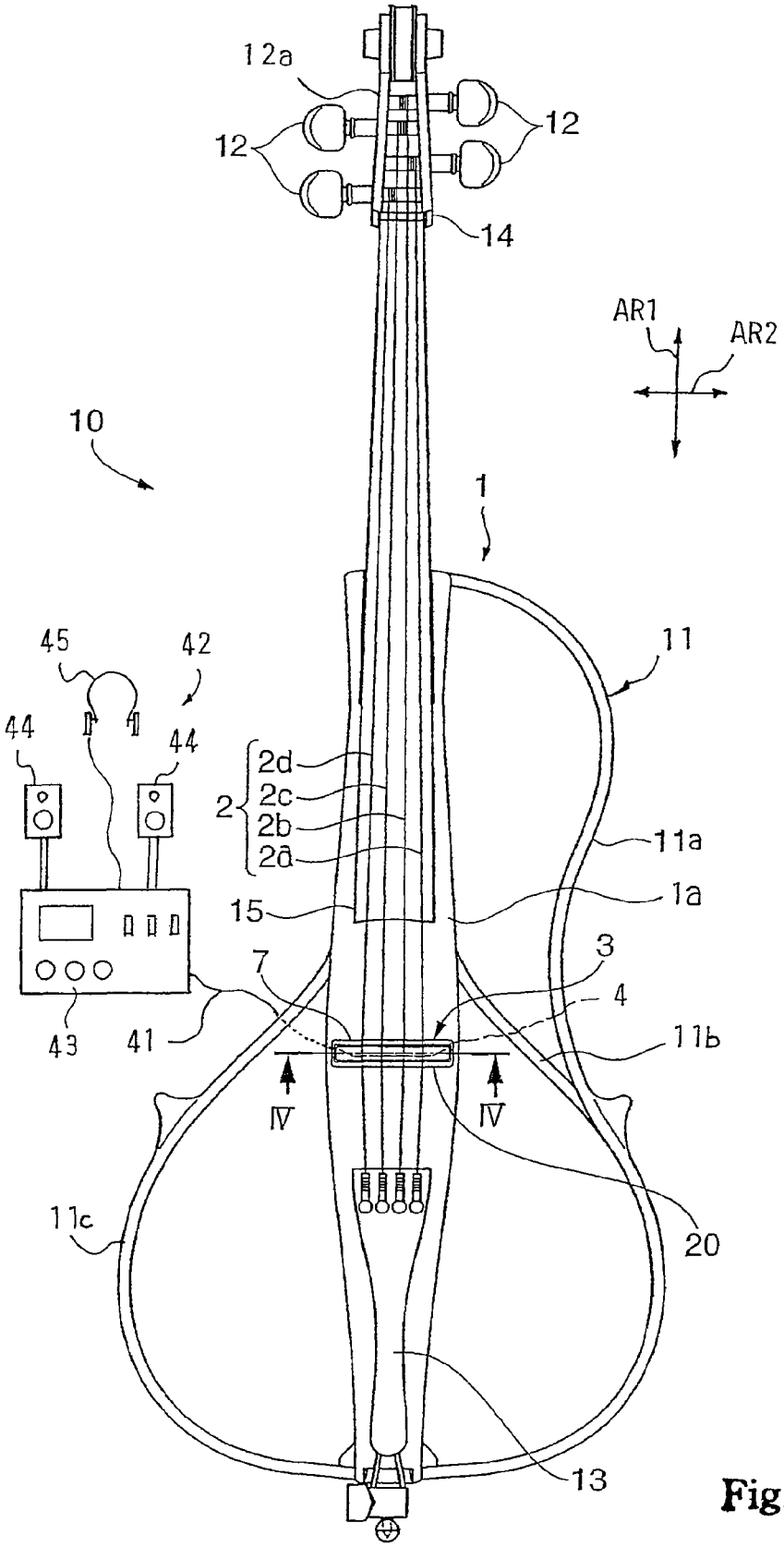
FIG. 3 is a plane view showing an electric cello according to the present invention.

Referring to FIG. 3 of the drawings, an electric cello embodying the present invention is designated in its entirety by reference numeral 10. The electric cello 10 comprises an instrument body 1, strings 2, a bridge 3 and a pickup unit 4. The strings 2 are stretched over the instrument body 1, and are anchored at both ends thereof to the instrument body 1. Therefore, the longitudinal direction is indicated by arrows AR1, and arrows AR2 are indicative of the lateral direction. The perpendicular direction is normal to a plane defined by the longitudinal direction AR1 and lateral direction AR2, and is indicated by arrows AR3 in FIG. 4.

The bridge 3 stands on the pickup unit 4. The strings 2 are held in contact with an upper surface of the bridge 3, and the bridge 3 gives tension to the strings 2. For this reason, vibrations are propagated from the strings 2 to the bridge 3, and gives rise to rolling of the bridge 3 on the pickup unit 4. The pickup unit 4 is embedded in the instrument body 1 under the bridge 3, and the rolling is propagated from the bridge 3 to the pickup unit 4. The rolling of bridge 3 makes the pickup unit 4 repeatedly deformed, and the deformation is converted to an audio electric signal.

The pickup unit 4 is connected through a cable 41 to a sound system 42. The sound system 42 includes an amplifier unit 43, i.e., a pre-amplifier and a main amplifier, loud speakers 44 and a headphone 45. The audio electric signal is equalized and increased in magnitude in the amplifier unit 43, and, thereafter, is converted to electric signals through the loudspeakers 44 and/or headphone 45. Since the electric signal is converted to the electric tones through the sound system 42, any resonator is not required for the electric cello 10.

The pickup unit 4 is secured at a side portion to the instrument body 1*a* so as to be restrained at the side portion from deformation due to vibrations. However, the other side portion of the pickup unit 4 is simply put on the instrument body 1 without any restraint. For this reason, the other side portion of pickup unit 4 is repeatedly deformed on the instrument body 1 due to the rolling of bridge 3. In other words, the vibrations of strings 2 repeatedly give rise to the deformation of the other side portion of the pickup unit 4. Even though the bridge 3 rolls on the side portion of the pickup unit 3, the side portion, which is secured to the instrument body 1*a*, is not deformed, and has no influence on the pickup unit 3.

Description is hereinafter made on the component parts of the electric cello 10 in detail.

Figure 4:
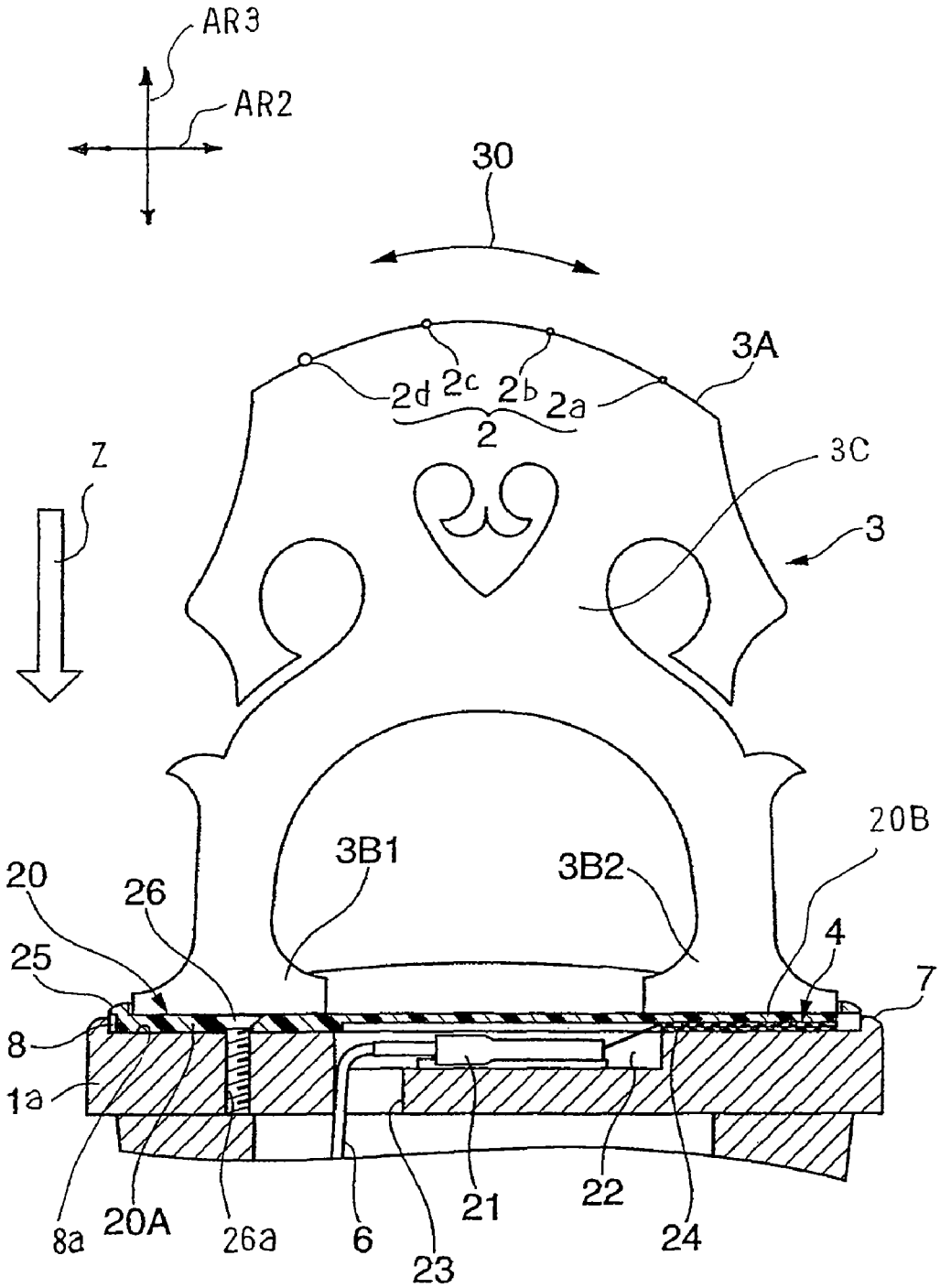
FIG. 4 is a cross sectional view taken along line IV-IV in FIG. 3 and showing a pickup unit under a bridge.

The instrument body 1 is broken down into a trunk 1*a*, a framework 11, pegs 12, a peg box 12*a*, a tailpiece 13, a nut 14 and a fingerboard 15. The trunk 1*a* extends in the longitudinal direction AR1, and is formed with a chamber 22 as shown in FIG. 4. The chamber 22 is located beneath the bridge 3, and is wide enough to accommodate the pickup unit 4.

The framework 11 has a side frame 11*a*, a rib 11*b* and another side frame 11*c* . The side frame 11*a* projects from one of the side surfaces of the trunk 1*a*, and is connected at one end thereof to an intermediate area of the side surface of the trunk 1*a* and at the other end thereof to an aft area of the side surface of the trunk 1*a* . The side frame 11*a* is constricted at an intermediate portion so that the side frame 11*a* makes users image the contour of a half of soundboard of an acoustic cello. The rib 11*b* is connected at one end thereof to the side frame 11*a* and at the other end thereof to the trunk 1*a* so as to reinforce the side frame 11*a* . The other side frame 11*c* projects from the other side surface of the trunk 1*a* oppositely to the side frame 11*a*, and is connected at one end thereof to an intermediate area of the other side surface and at the other end thereof to an aft area of the other side surface. Although the aft area of the side surface is corresponding to the aft area of the other side surface, the intermediate area of the side surface is closer to the aft area than the intermediate area of the other side surface so that the other side frame 11*c* is shorter than the side frame 11*a* . The other side frame 11*c* is symmetrical with the combination of the rib 11*c* and rear portion of the side frame 11*a* .

The peg box 12*a* is secured to the fore portion of the trunk 1*a*, and projects from the fore end of the trunk 1*a* . The pegs 12 extend across the peg box 12*a* in parallel to the lateral direction AR2, and are rotatably supported by the peg box 12*a* . In this instance, two pegs 12 project from one of the side surfaces of the peg box 12*a*, and the remaining two pegs 12 project from the other side surface of the peg box 12*a* .

The tailpiece 13 is secured to the aft portion of the trunk 1*a*, and has an aft portion spaced from the upper surface of the aft portion of the trunk 1*a*. On the other hand, the nut 14 is secured to the foremost portion of the trunk 1*a*, and extends in the lateral direction AR2.

The fingerboard 15 is secured to the upper surface of the fore portion of the trunk 1*a*, and the fore end of the fingerboard 15 is held in contact with the nut 14. The nut 14 has an upper surface farther from the upper surface of the trunk 1*a* than an upper surface of the fingerboard 15.

Four strings 2*a*, 2*b*, 2*c* and 2*d* are wound on the pegs 12, respectively, and are anchored at the other end portions thereof to the tailpiece 13. The string 2*d* is the thickest of all, and a player bows on the string 2*d* to produce the electric tones in the lowest pitched part. On the other hand, the string 2*a* is thinnest of all, and the player bows on the string 2*a* to produce the electric tones in the highest pitched part.

The bridge 3 is a thin plate, and is made of hard wood. As will be better seen in FIG. 4, the bridge 3 has a crown portion 3A, two leg portions 3B1 and 3B2 and an intermediate portion 3C between the crown portion 3A and the leg portions 3B1 and 3B2. The strings 2*a*, 2*b*, 2*c* and 2*d* extend across the bridge 3, and are held in contact with the upper surface of the crown portion 3A. The downward component force of the tension is exerted on the upper surface of the crown portion 3A, and makes the bridge 3 stand on the pickup unit 4. The intermediate portion 3*c* is constricted, and the two leg portions 3B1 and 3B2 project from the intermediate portion 3*c* downwardly and sidewardly. The bridge 3 sets the two leg portions 3B1 and 3B2 on the pickup unit 4. However, the two leg portions 3B1 and 3B2 are not secured to the pickup unit 4. The bridge 3 is pressed at the two leg portions 3B1 and 3B2 on the pickup unit 4. Thus, the downward component force keeps the bridge 3 upright on the pickup unit 4.

Figure 5:
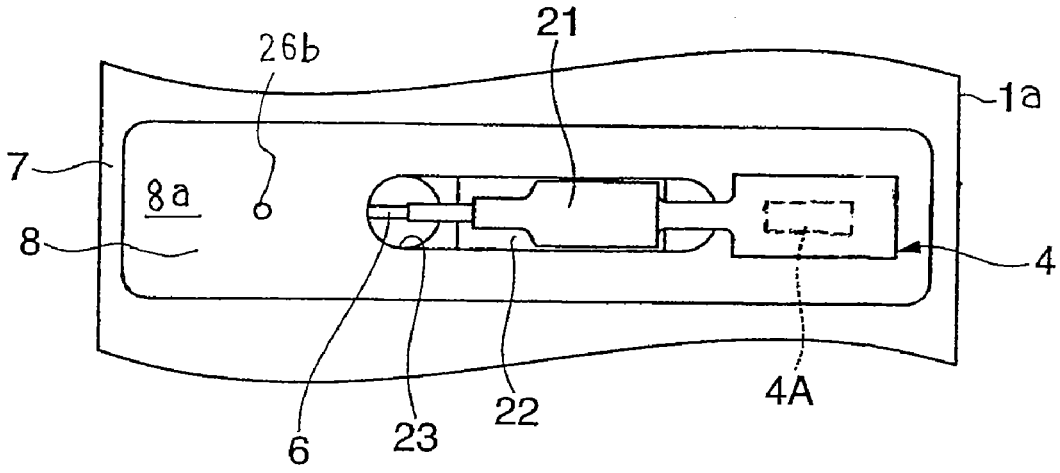
FIG. 5 is a plane view showing a piezoelectric transducer accommodated in a chamber formed in an instrument body of the electric cello.

The pickup unit 4 has a bridge tray 20, a bimorph piezoelectric transducer 4A (see FIG. 5), a connector 21, a resilient plate 24 and a fixture 26. The bridge 3 is placed on the bridge tray 20, and is pressed to the bridge tray 20 due to the tension of the strings 2*a*, 2*b*, 2*c* and 2*d*. The bridge tray 20 is secured at the side portion 20A to the instrument body 1*a* by means of the fixture 26. The side portion 20A is directly held in contact with the instrument body 1*a*, and the instrument body 1*a*, which the side portion 20A is held in contact with, is so stiff that the rolling bridge 3 can not deform the instrument body 1*a*. However, the other side portion 20B is movable on the instrument body 1*a*. The bimorph piezoelectric transducer 4A is provided under the other side portion 20B, and the resilient plate 24 is inserted between the other side portion 20B and the bimorph piezoelectric transducer 4A. The bimorph piezoelectric transducer 4A is connected to the joint 21, and is electrically connected to a signal output cable 6 through the joint 21.

While a player is bowing on the strings 2*a*, 2*b*, 2*c* and 2*d*, the vibrating strings 2*a*, 2*b*, 2*c* and 2*d* give rise to the rolling of the bridge 3, and the bridge 3 alternately tramples on the leg portions 3B1 and 3B2. As a result, the force Z is alternately exerted on the side portions 21A and 21B. The leg portion 3B2 makes the bimorph piezoelectric transducer 4A deformed together with the bridge tray 20 and resilient plate 24. However, the leg portion 3B1 does not make the bridge tray 20 deformed. As a result, the bimorph piezoelectric transducer 4A converts the deformation of side portion 20B without any interference of the side portion 20A.

In more detail, a shallow recess 8 is formed in the instrument body 1*a*, and extends in the lateral direction. The bottom surface 8A, which defines the bottom of the shallow recess 8, is retracted from a peripheral surface 7, which form a part of the upper surface of the instrument body 1*a* . The chamber 22 is deeper than the shallow recess 7, and is open onto the bottom surface 8*a* . A hole 23 is open to the chamber 22, and the signal output cable 6 passes through the hole 23. The signal output cable 6 is terminated at a socket (not shown) on the reverse surface of the instrument body 1*a*, and a jack (not shown) connected to the cable 41 is plugged in the socket so as to electrically connect the sound system 42 to the pickup unit 4.

Figure 6:
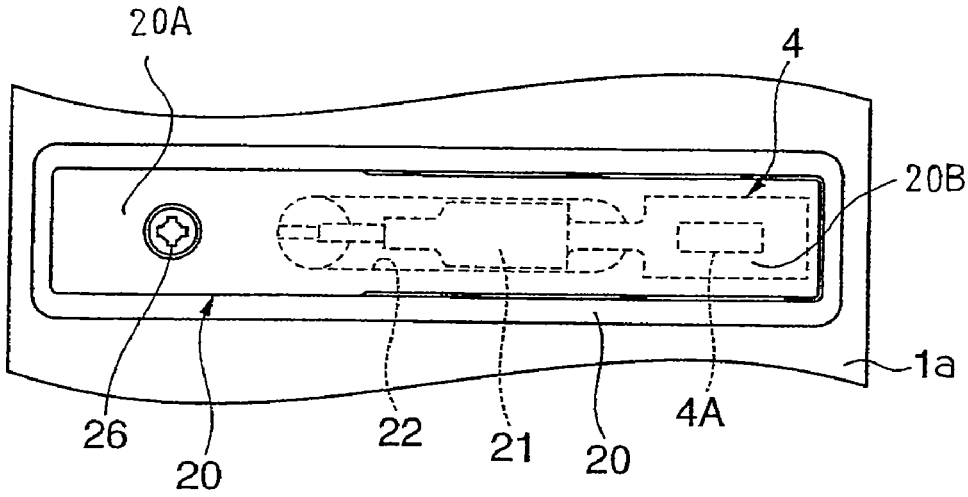
FIG. 6 is a plane view showing a bridge tray provided on the piezoelectric transducer.
Figure 7:
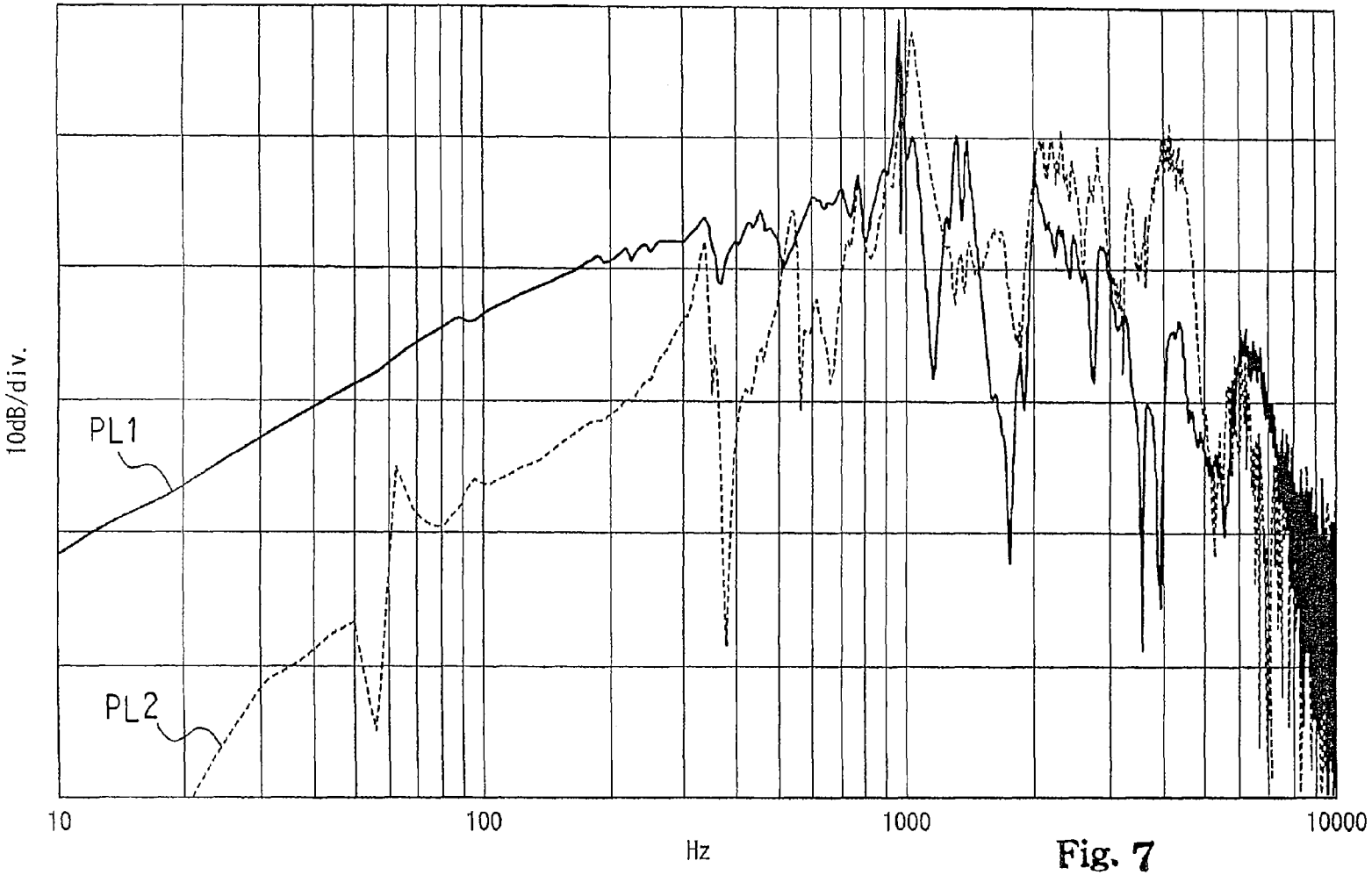
FIG. 7 is a graph showing frequency response characteristics of the pickup unit of the present invention.
Figure 8:
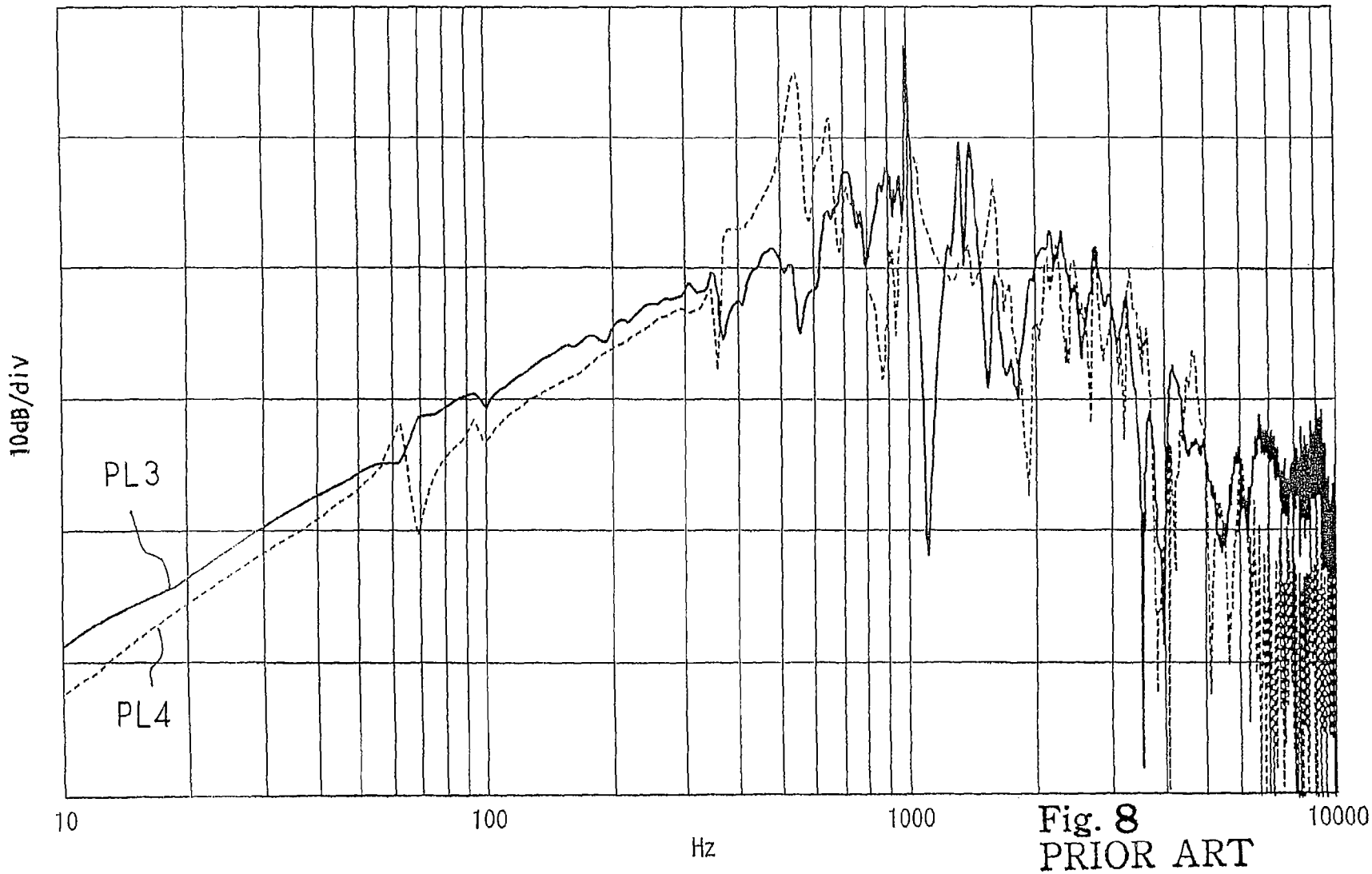
Fig. 8 PRIOR ART
FIG. 8 is a graph showing frequency response characteristics of the prior art pickup unit.

The shallow recess 8 has a rectangular periphery, and the rectangular periphery is corresponding to the periphery of the bridge tray 20. For this reason, the bridge tray 20 is snugly received in the shallow recess 8 as shown in FIG. 6. The bridge tray 20 is made of synthetic resin, and, accordingly, is deformable. The legs 3B1 and 3B2 of bridge 3 are spaced from each other in the lateral direction on the bridge tray 20. Since the periphery of bridge tray 20 is raised like a rampart, the legs 3B1 and 3B2 are not moved out of the bridge tray 20. Although the bridge tray 20 has a flat upper surface, the side portion 20B is thinner than the side portion 20A is, and the reverse surface of the side portion 20B is upwardly retracted from the reverse surface of the side portion 20A.

In this instance, the fixture 26 is implemented by a bolt 26 and a threaded hole 26*a* formed in the instrument body 1*a* (see FIG. 5), and is open to the shallow recess 8. A through-hole is formed in the side portion 20A of the bridge tray 20, and is aligned with the threaded hole 26*a* on the conditions that the bridge tray 20 is snugly received in the shallow recess 8. The bolt 26 is driven into the headed hole 26*b* through the hole so that the side portion 20A is pressed to the area of bottom surface 8*a* on the left side of the chamber 22.

The bimorph piezoelectric transducer 4A is made of piezoelectric copolymer. Another sort of piezoelectric transducer is available for the pickup unit 4. For example, a piezoelectric transducer may have a multiple layered structure of an insulating synthetic resin layer and a piezoelectric material layer. The bimorph piezoelectric transducer 4A is located over an area of the bottom surface 8*a* on the right side of the chamber 22 in shown in FIG. 5. The thinnest string 2*a* passes over the area located on the right side of the chamber 22. When the bridge tray 20 is snugly received in the shallow recess 8, the reverse surface of the side portion 20B of bridge tray 20 is in contact with the bimorph piezoelectric transducer 4A. Thus, the bimorph piezoelectric transducer 4A is sandwiched between the side portion 20B of bridge tray 20 and the resilient plate 24. As described hereinbefore, the reverse surface of side portion 20B is upwardly retracted from the reverse surface of the side portion 20A so that the resilient plate 24 and bimorph piezoelectric transducer 4A is placed between the side portion 20B and the area of bottom surface 8*a* on the right side of the chamber 22 in FIG. 5 without serious stress. The bimorph piezoelectric transducer 4A converts the mechanical stress to electric charge, and the electric charge flows out into the signal output cable 6 as the electric signal representative of the frequency of the rolling of the bridge 3.

The resilient plate 24 is made of rubber, and is resiliently deformable in the presence of the force Z. The resilient plate 24 is placed on the area of bottom surface 8*a* on the right side of the chamber 22 in FIG. 5, and is overlain with the bimorph piezoelectric transducer 4A. The resilient plate 24 permits the bimorph piezoelectric transducer 4A to be deformed in the presence of force Z. Moreover, the resilient plate 24 does not permit the bimorph piezoelectric transducer 4A from being excessively deformed, and prevents the bimorph piezoelectric transducer 4A from breakage. A player is assumed to be bowing on the strings 2*a*, 2*b*, 2*c* and 2*d* under the application of downward force component to the bridge 3. The vibrating strings 2*a*, 2*b*, ac and 2*d* give rise to the rolling of bridge 3 in the lateral direction as indicated by arrows 30 in FIG. 4, and the force Z is repeatedly exerted on the side portions 20A and 20B. In other words, the legs 3B1 and 3B2 vibrates on the side portions 20A and 20B. Although the leg 3B2 gives rise to the vibrations of the side portion 20B, the fixture 26 prohibits the side portion 20A from vibrations. For this reason, only the side portion 20B gives rise to repeated deformation of the bimorph piezoelectric transducer 4A, and the side portion 20A does not interfere with the deformation of bimorph piezoelectric transducer 4A. As a result, the electric signal, which expresses the vibrations of strings 2*a*, 2*b*, 2*c* and 2*d* at high fidelity, is taken out from the pickup unit 4. This is the outline of the behavior of bridge 3 and pickup unit 4 during the performance on the electric cello 10.

The reason why the bimorph piezoelectric transducer 4A is provided under the side portion 20B is described together with the behavior of bridge 3 in more detail. Although the bridge 3 basically behaves in the presence of vibrations of strings 2*a*, 2*b*, 2*c* and 2*d* as described hereinbefore, the vibrations of strings 2 give rise to other sorts of vibrations of the bridge 3 mixed with the vibrations indicated by arrows 30.

One of the other sorts of vibrations is recognizable as twisting motion of the bridge 3 during the vibrations of strings 2 for producing tones in higher pitched part. Another sort of vibrations takes place during the vibratos and in the event that the player varies the pressure of the bow on the strings 2, and is recognizable as the vibrations in the longitudinal direction AR1. The pickup unit 4 is expected to convert those sorts of vibrations to the electric signal.

There is the highest possibility to produce tones in the higher pitched part through the vibrations of string 2*a* . The vibration exciting force is exerted on the bridge 3 at the contact area between the string 2*a* and the crown portion 3A so that the leg 3B2 is moved much widely rather than the leg 3B1 is. For this reason, it is desirable to make the side portion 20B freely vibrate. Although putting either side portion 20A or side portion 20B under restrain is required against the interference, it is desirable to make the side portion 20B freely vibrate from another viewpoint of higher fidelity. For this reason, the side portion 20A is restrained by means of the fixture 26. As will be understood from the foregoing description, one of the side portions 20A and 20B is restrained, and the other of the side portions 20A and 20B is made free to vibrate. As a result, the bridge tray 20 prohibits the piezoelectric transducer 4A from the interference between the vibrations of leg 3B1 and the vibrations of leg 3B2 due to the vibrations indicated by arrows 30. This results in the electric tones at high fidelity.

Moreover, the restrain is put on the side portion 20A under the thick string 2*d* . The non-restrained side portion 20A under the thin string 2*a* is caused well to respond to the other sorts of vibrations. For this reason, the fidelity of electric tones is enhanced.

The resilient plate 24 permits the piezoelectric transducer 4A to be repeatedly deformed without any damage. For this reason, the resilient plate 24 makes the pickup unit 4 durable.

The structure of piezoelectric transducer 4A, i.e., the multi-layered structure of insulating firm and piezoelectric material layer is promptly responsive to the vibrations of the side portion 20B, and is desirable rather than another structure.

Figure 1:
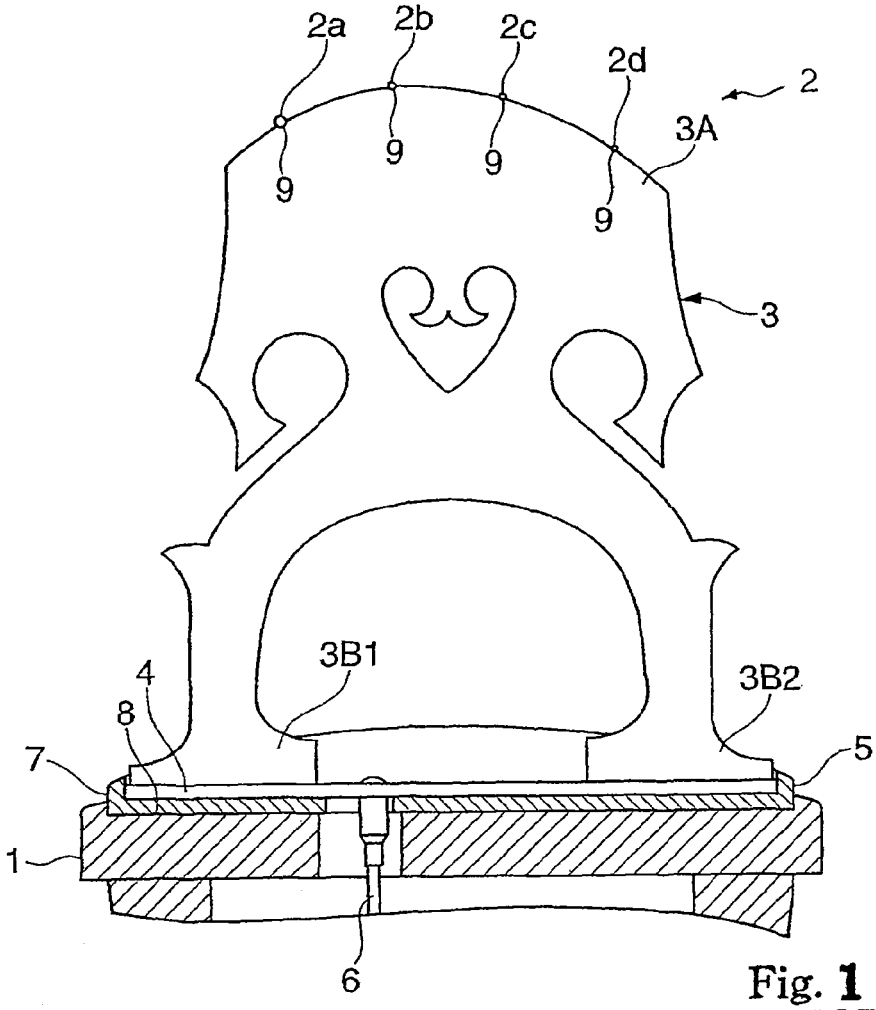
Fig. 1 PRIOR ART
FIG. 1 is a cross sectional view showing a bridge standing on an instrument body and a vibration-to-electric signal converter incorporated in the prior art electric stringed musical instrument.
Figure 2:
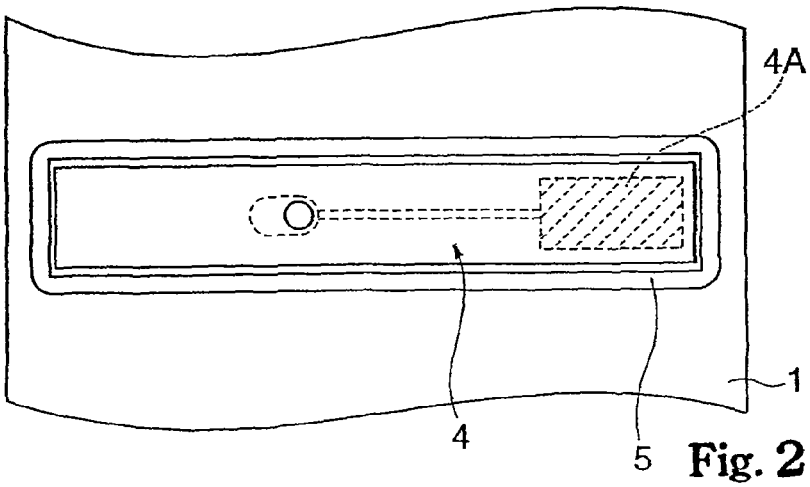
Fig. 2 PRIOR ART
FIG. 2 is a plane view showing the vibration-to-electric signal converter under the bridge.

The present inventor evaluated the pickup unit 4 in comparison with the prior art pickup unit shown in FIG. 1 through experiments. The experiments were carried out as follows. The electric cello 10 was equipped with the pickup unit 4, and the pickup unit 4 was replaced with the prior art pickup after the experiment on the pickup unit 4. The electric cello 10 was prepared.

The thickest string and thinnest string are used to be tuned at 66 Hz and 221 Hz. Although the heist pitched tone is of the order of 400 Hz in ordinary performances, the cello is capable of producing tones at extremely high pitch through the harmonics or flageolet tones. The cello's tones are rich in harmonics, and higher-order harmonics exceed the audible range around 20 kHz.

The present inventor gave rise to the vibrations by striking the bridge 3 with an impulse hammer. The vibrations of bridge were propagated to the pickup unit 4, and the pickup unit 4 produces the electric signal expressing the vibrations. The electric signal was monitored through a suitable system, and was analyzed for frequency response characteristics. The experiment was also carried out for the prior art pickup unit. In the experiment on the prior art pickup unit, the electric signal was regulated in such a manner that the sound pressure was equalized to the sound pressure in the experiment for the pickup unit 4 of the present invention.

Term "lateral vibrations" means the vibrations due to the rolling of the bridge 3, and term "longitudinal vibrations" means the vibrations due to the movements of the bridge 3 in the longitudinal direction.

The frequency response characteristics are plotted in FIGS. 7 to 10. Plots PL1 were indicative of the frequency response characteristics of the pickup unit 4 of the present invention to the lateral vibrations, and plots PL2 were indicative of the frequency response characteristics of the pickup unit 4 of the present invention to the longitudinal vibrations. Plots PL3 were indicative of the frequency response characteristics of the prior art pickup unit to the lateral vibrations, and plots PL4 were indicative of the frequency response characteristics of the prior art pickup unit to the longitudinal vibrations.

Comparing plots PL1 with plots PL3, it is understood that the pickup unit 4 of the present invention exhibited the response superior in the fundamental frequency range of the cello's tones, i.e., 66 Hz to 400 Hz and in the frequency range around 700 Hz to the response of the prior art pickup unit. For this reason, the players felt the electric tones produced through the electric cello 10 equipped with the pickup unit 4 richer than the electric tones produced through the electric cellos equipped with the prior art bridge.

Figure 9:
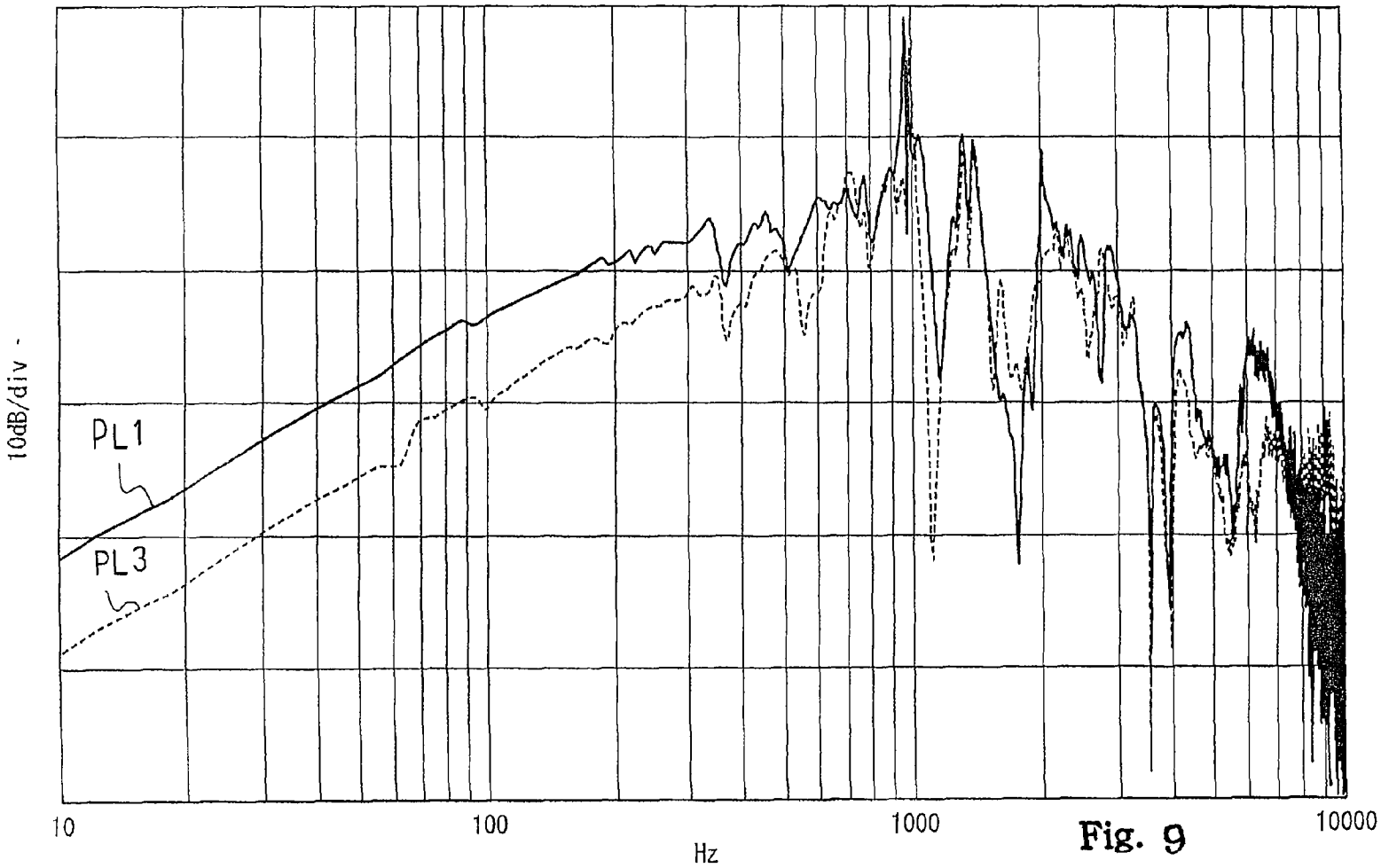
FIG. 9 is a graph showing the frequency response characteristics to lateral vibrations.

When the frequency response characteristics from 1 kHz to 4 kHz was equalized between the electric cello 10 equipped with the pickup unit 4 of the present invention and the electric cello equipped with the prior art pickup unit, the tendency was clearly seen as shown in FIG. 9.

Figure 10:
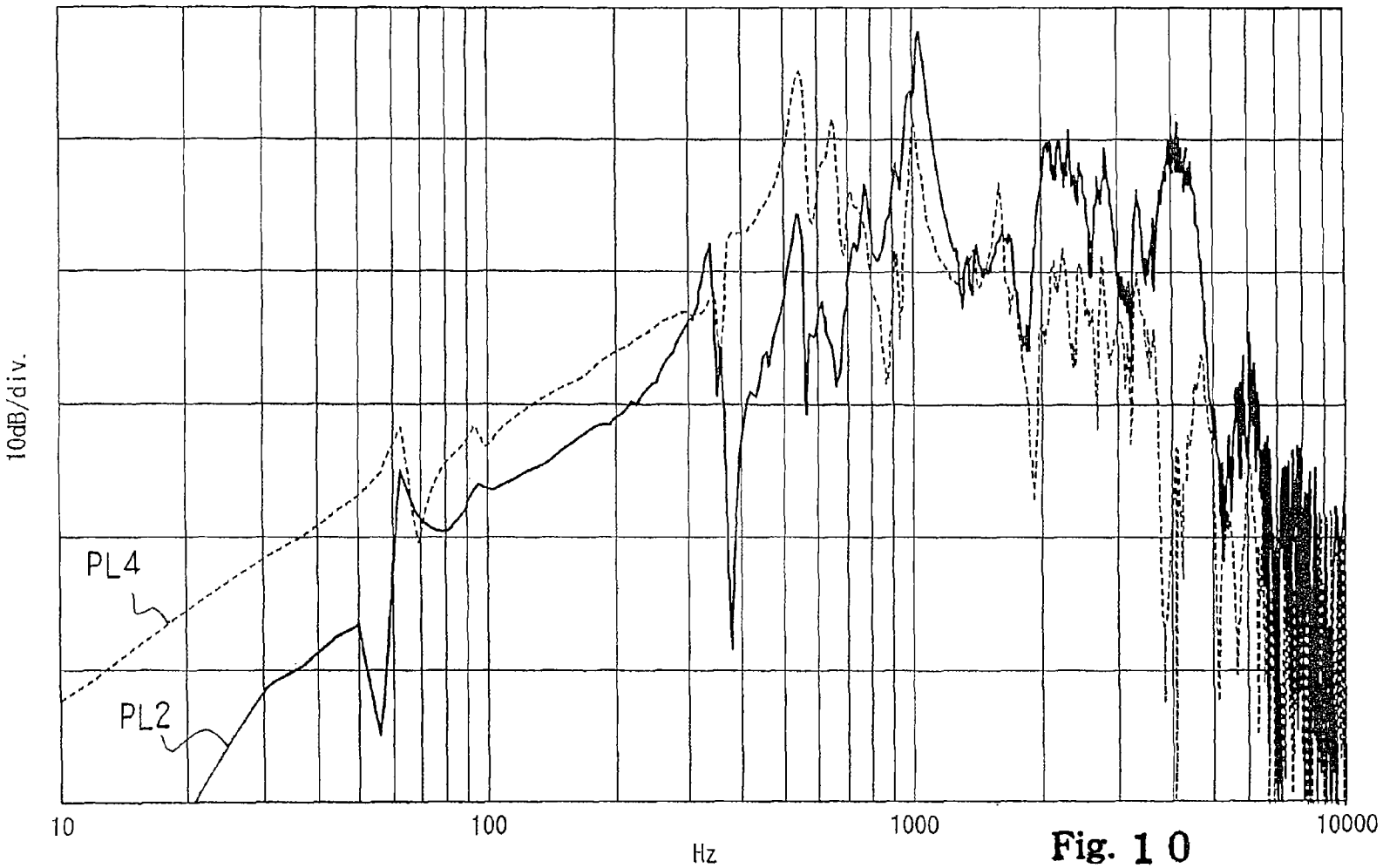
FIG. 10 is a graph showing the frequency response characteristics to longitudinal vibrations.

Comparing plots PL2 with plots PL4, it is understood that the pickup unit 4 of the present invention exhibited the response inferior in the higher-pitched part to the response to the prior art pickup unit as shown in FIG. 10. In detail, players know that the vibrato and timbre are important in the higher pitched part for the artificial expression. The vibrato gives rise to the vibrations in the longitudinal direction, and the change of bow pressure also gives rise to the movements of bridge in the longitudinal direction. The vibrato and change of bow pressure make harmonics varied, and this phenomenon makes the players and audience perceive those styles of rendition. The pickup unit 4 exhibited good response to the longitudinal vibrations of bridge 3 at the higher pitched part so that players can easily impart the artificial expression to tunes through the electric cello 10 equipped with the pickup unit 4 of the present invention.

However, the response of the pickup unit 4 was poor in the fundamental frequency range rather than the response of the prior art pickup unit. This frequency response characteristics are desirable for the electric cello, because the lateral vibrations less interfere with the longitudinal vibrations. This is another reason why the rich electric tones were produced through the electric cello equipped with the pickup unit 4.

Thus, the pickup unit 4 of the present invention is superior in the frequency response characteristics in both of the high pitched part and low pitched part to the prior art pickup unit.

Second Embodiment

Figure 11:
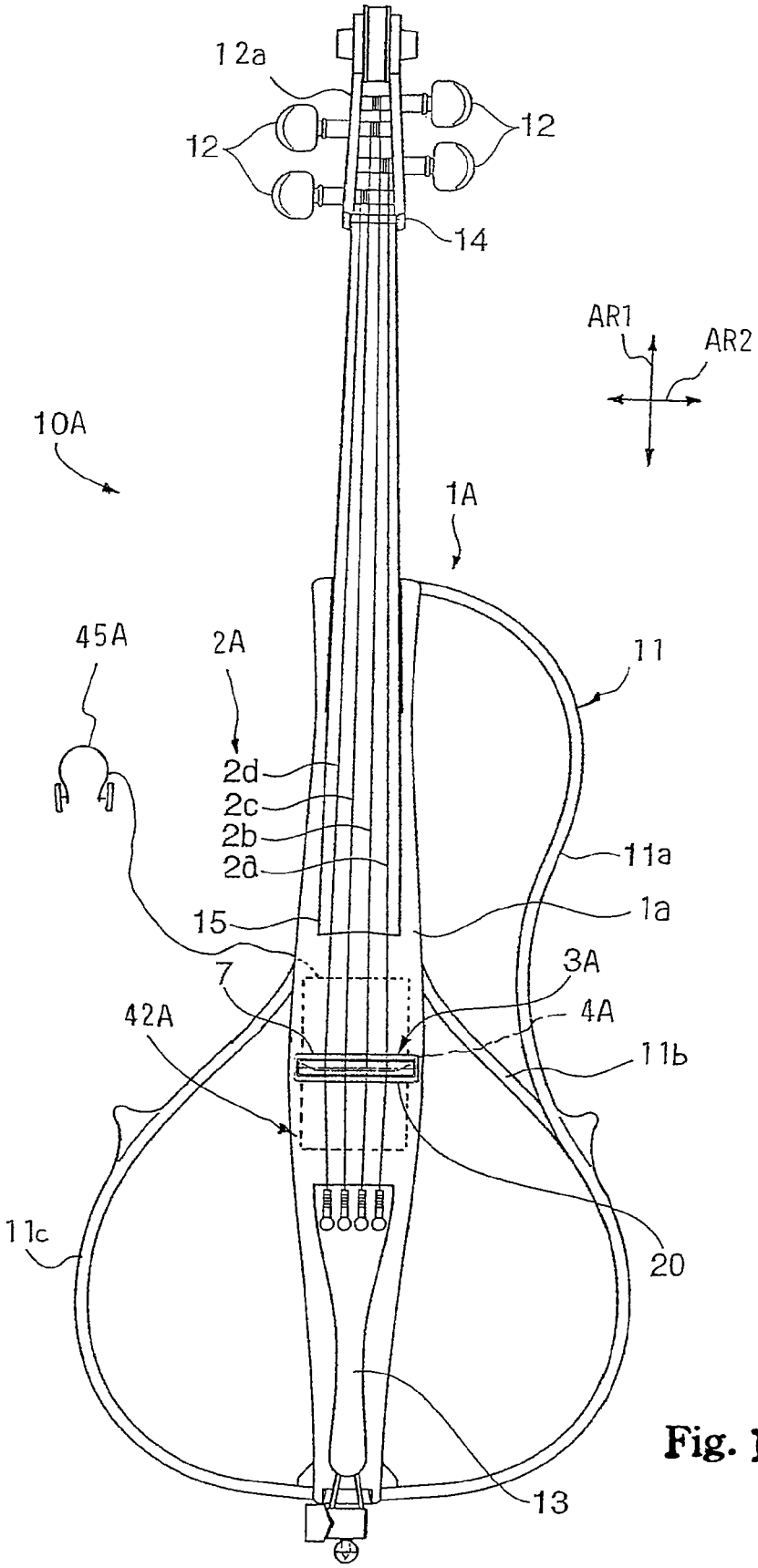
FIG. 11 is a plane view showing another electric cello according to the present invention.

Turning to FIG. 11 of the drawings, another electric rubbed string musical instrument 10A embodying the present invention largely comprises an instrument body 1A, strings 2A, a bridge 3A and a pickup unit 4A as similar to the electric cello 10. The electric rubbed stringed musical instrument 10A further comprises a sound system 42A. Since the sound system 42A has an output socket (not shown), it is possible to supply the electric signal through the output socket to an external sound system like the sound system 42. The instrument body 1A, strings 2A, bridge 3A and pickup unit 4A are similar in structure to the instrument body 1, strings 2, bridge 3 and pickup unit 4, and, for this reason, the component parts thereof are labeled with references designating the corresponding component parts of the instrument body 1, strings 2, bridge 3 and pickup unit 4 without detailed description.

The built-in sound system 42A is simpler than the sound system 42. In this instance, the electric signal is converted to the electric tones only by means of a headphone 45A. However, small-size loud speakers may be further incorporated in the built-in sound system 42A. The electric power is directly supplied from a home socket to the built-in sound system 42A. However, a suitable battery may be provided inside the instrument body 1A.

The electric rubbed string musical instrument 10A achieves all the advantages of the electric cello 10. Moreover, the built-in sound system 42 makes the electric rubbed string musical instrument 10A enhanced in portability.

Although particular embodiments of the present invention have been shown and described, it will be apparent to those skilled in the art that various changes and modifications may be made without departing from the spirit and scope of the present invention.

The electric cello 10 does not set any limit to the technical scope of the present invention. An electric violin, an electric viola and an electric double base may be equipped with the pickup unit 4 of the present invention. A hybrid violin, a hybrid viola, a hybrid cello and a hybrid double base may have both of the resonating chamber and pickup unit 4. The electric signal output from the pickup unit 4 or 4A may be sampled and converted to a digital signal so as to analyze the digital signal for electronically producing tones.

The rubbed string musical instrument does not set any limit to the technical scope of the present invention. The present invention may appertain to any sort of stringed musical instrument in so far as vibrations of strings are propagated from the strings through a vibratory medium such as, for example, a bridge to the vibration-to-electric signal converter.

The bimorph piezoelectric transducer does not set any limit to the technical scope of the present invention. A monomorph piezoelectric transducer may be used in a pickup unit of the present invention.

The bolt 26 does not set any limit to the technical scope of the present invention. Another sort of mechanical fixture such as, for example, a key or a clamp may be used for the bridge tray 20. Of course, the mechanical fixture does not set any limit to the technical scope of the present invention. A pair of magnetic pieces may serve as the fixture. In this instance, one of the magnet pieces is embedded in the instrument body 1*a*, and the other of the magnetic pieces is embedded in the bridge tray 20.

The piezoelectric transducer 4A does not set any limit to the technical scope of the present invention. The rolling motion of the bridge may be electromagnetically converted to the electric signal. Otherwise, a strain gage or a semiconductor strain sensor may be used as a pickup unit.

The pickup unit 4 may be connected to a controller of an automatic player musical instrument or a suitable playback system for a compact disk or a DVD disk for ensemble.

The restrain on the side portion 20A does not set any limit to the technical cope of the invention from the viewpoint that the pickup unit 4 is to be prohibited from the interference.

The resilient plate 24 is not an indispensable element of the present invention. In case where the piezoelectric transducer 4A is adhered to the reverse surface of the side portion 20B, it is possible to delete the resilient plate 24 from between the bottom surface 8*a* and the piezoelectric transducer 4A.

The material for the bridge 3 does not set any limit to the technical scope of the present invention. For example, the bridge 3 may be made of synthetic resin. The contour of bridge 3 does not set any limit to the technical scope of the present invention. Even if the lower part of bridge is not bifurcated, the restrain on a side portion makes the pickup unit 4 free from the interference.

The component parts of the electric stringed musical instruments 10/10A are correlated with claim languages as follows. The instrument body 1/1A, strings 2/2A, bridge 3/3A and pickup units 4/4A are referred to as "an instrument body", "strings", "a bridge" and "a pickup unit" in claims. The mono-morph piezoelectric converter 4A serves as a "vibration-to-electric signal converter". The resilient plate 24 is corresponding to a "resiliently deformable plate". The threaded hole 26*a* and bolt 26 serve as a "female screw" and a "male screw", respectively.

What is claimed is:

1. An electric stringed musical instrument for producing electric tones, comprising:

an instrument body having a longitudinal direction and a lateral direction, said instrument body including a body top surface, which defines an upper extent of said instrument body;

plural strings stretched over said body top surface in said longitudinal direction, and selectively vibrating for specifying the electric tones to be produced;

a bridge provided between said plural strings and said body top surface, the vibrating strings giving rise to rolling of said bridge; and a pickup unit provided between said bridge and said body top surface for converting said rolling of said bridge to an electric signal representative of the specified electric tones, said pickup unit including a bridge tray having a first side portion, second side portion contiguous with said first side portion, a first tray surface on which said bridge stands and a second tray surface opposite to said first tray surface and spaced from said body top surface, whereby said rolling of said bridge gives rise to vibrations of said bridge tray, a fixture restraining said first side portion to said instrument body and permitting said second side portion to freely vibrate, and a vibration-to-electric signal converter inserted between said second tray surface proximate to said second side portion and said body top surface and converting said vibrations of said second side portion to said electric signal.

2. The electric stringed musical instrument as set forth in claim 1, in which said vibration-to-electric signal converter has a piece of piezoelectric material, which converts stress exerted thereon due to said vibrations of said second side portion to said electric signal.

3. The electric stringed musical instrument as set forth in claim 2, in which said pickup unit further includes a resiliently deformable plate inserted between said body top surface and said piece of said piezoelectric material so that said piece of piezoelectric material is sandwiched between said second tray surface proximate to said second side portion of said bridge tray and said resiliently deformable plate.

4. The electric stringed musical instrument as set forth in claim 3, in which said piece of piezoelectric material is made of piezoelectric copolymer so that said vibrations of said second side portion give rise to deformation of said piezoelectric copolymer and resilient deformation of said resiliently deformable plate.

5. The electric stringed musical instrument as set forth in claim 3, in which said vibration-to-electric signal converter and said resiliently deformable plate are housed in a hollow space formed by a part of said body top surface, and said hollow space is closed with said bridge tray.

6. The electric stringed musical instrument as set forth in claim 1, in which said plural strings are selectively rubbed through bowing on said plural strings in said lateral direction so as to give rise to said rolling of said bridge, and the tension exerted on selected one or selected ones of said plural strings are varied during said bowing so that said selected one or selected ones of said plural strings repeatedly incline said bridge in said longitudinal direction.

7. The electric stringed musical instrument as set forth in claim 6, in which one of said plural strings for a higher pitched part is closer to said second side portion than another of said plural strings for a lower pitched part is, whereby said vibration-to-electric signal converter produces said electric signal expressing said rolling and the repeated inclination of said bridge at high fidelity.

8. The electric stringed musical instrument as set forth in claim 1, in which said fixture makes said first side portion unmoved with respect to said body top surface.

9. The electric stringed musical instrument as set forth in claim 8, in which said fixture includes a female screw formed in said instrument body and open to said body top surface and a male screw held in threaded engagement with said female screw for pressing said first side portion to said body top surface so as to make said first side portion unmoved with respect to said body top surface.

10. The electric stringed musical instrument as set forth in claim 1, in which said electric signal is supplied from said pickup unit to a sound system so that said electric signal is converted to electric tones.

11. The electric stringed musical instrument as set forth in claim 10, in which said sound system is physically separated from said instrument body, said strings, said bridge and said pickup unit so that said pickup unit is electrically connected to said sound system through an external cable.

12. A pickup unit used for an electric stringed musical instrument having a longitudinal direction, a lateral direction and a body top surface which defines an upper extent of an instrument body of said electric stringed musical instrument, said pickup unit comprising:

a bridge tray having a first side portion, a second side portion contiguous with said first side portion, a first tray surface on which a bridge of said electric stringed musical instrument stands and a second tray surface opposite to said first tray surface and spaced from said body top surface, whereby rolling of said bridge gives rise to vibrations of said bridge tray, a fixture restraining said first side portion to said instrument body of said electric stringed musical instrument, and permitting said second side portion to freely vibrate; and a vibration-to-electric signal converter inserted between said second tray surface proximate to said second side portion and said body top surface and converting said vibrations of said second side portion due to said rolling of said bridge to an electric signal expressing electric tones specified through vibrations of strings of said electric musical instrument.

13. The pick up unit as set forth in claim 12, in which said vibration-to electric signal converter has a piece of piezoelectric material, which converts stress exerted thereon due to said vibrations of said second side portion to said electric signal.

14. The pickup unit as set forth in claim 13, in which said pickup unit further includes a resiliently deformable plate inserted between said body top surface and said piece of said piezoelectric material so that said piece of piezoelectric material is sandwiched between said second tray surface proximate to said second side portion of said bridge tray and said resiliently deformable plate.

15. The pickup unit as set forth in claim 14, in which said piece of piezoelectric material is made of piezoelectric copolymer so that said vibrations of said second side portion give rise to deformation of said piezoelectric copolymer and resilient deformation of said resiliently deformable plate.

16. The pickup unit as set forth in claim 14, in which said vibration-to-electric signal converter and said resiliently deformable plate are housed in a hollow space formed by a part of said body top surface, and said hollow space is closed with said bridge tray.

17. The pickup unit as set forth in claim 12, in which said strings are selectively rubbed with bowing on said strings in said lateral direction so as to give rise to said rolling of said bridge, and the tension exerted on selected one or selected ones of said strings are varied during said bowing so that said selected one or selected ones of said strings repeatedly incline said bridge in said longitudinal direction.

18. The pickup unit as set forth in claim 17, in which one of said strings for a higher pitched part is closer to said second side portion than another of said strings for a lower pitched part is, whereby said vibration-to-electric signal converter produces said electric signal expressing said rolling and the repeated inclination of said bridge at high fidelity.

19. The pickup unit as set forth in claim 12, in which said fixture makes said first side portion unmoved with respect to said body top surface.

20. The pickup unit as set forth in claim 19, in which said fixture includes a female screw formed in said instrument body and open to said body top surface and a male screw held in threaded engagement with said female screw for pressing said first side portion to said body top surface so as to make said first side portion unmoved with respect to said body top surface.

* * * * *